United States Patent [19]

Cardin

[11] Patent Number: 4,739,567

[45] Date of Patent: Apr. 26, 1988

[54] DISPLAY WINDOW APERTURE ADVERTISING MEDIUM

[76] Inventor: Robert L. Cardin, 1255 State St., MRB 31, Bangor, Me. 04401

[21] Appl. No.: 835,975

[22] Filed: Mar. 4, 1986

[51] Int. Cl.[4] ..... G09F 19/00

[52] U.S. Cl. ..... 40/471; 40/560; 40/518; 40/624; 350/117

[58] Field of Search ..... 40/560, 471, 518, 541, 40/611, 619, 624; 160/253, 310; 350/117, 123; 353/28

[56] References Cited

U.S. PATENT DOCUMENTS

| | | | |
|---|---|---|---|
| 1,740,499 | 12/1929 | Cordill et al. | 40/427 |
| 2,145,880 | 2/1939 | Kalb | 40/560 |
| 2,200,959 | 5/1940 | Land | 40/541 |
| 2,491,184 | 12/1949 | Joss | 40/563 |
| 2,583,467 | 1/1952 | Burleigh et al. | 350/123 |
| 3,069,970 | 12/1962 | Pierson | 40/560 |
| 3,198,066 | 8/1965 | McGhee | 40/560 |
| 3,205,772 | 9/1965 | Guske | 350/117 |
| 3,543,425 | 12/1970 | Mulvey | 40/518 |
| 3,680,622 | 8/1972 | Lester, Jr. | 160/310 |
| 4,072,404 | 2/1978 | Brown | 160/310 |

*Primary Examiner*—John E. Murtagh
*Assistant Examiner*—Caroline D. Dennison
*Attorney, Agent, or Firm*—Daniel H. Kane, Jr.

[57] ABSTRACT

An image projection system is provided for projecting and displaying images at billboard or signboard scale in which a building display window defines the display aperture or viewing aperture of the image projection system for viewing projected images from outside the building. A deployable and retractible rear projection screen is positioned for deployment in the display aperture adjacent to the display window. A first timer is adjusted to actuate a screen motor and deploy the screen after daylight hours and actuate an image projector. Optical elements establish the focal plane of the projector at the display window aperture. A second timer sequentially advances the image projector for projection of sequential still images on the rear projection screen during selected time intervals of sufficient duration to avoid objectionable or distracting motion effects to viewers outside the building. The screen is retracted prior to daylight hours so that the display window functions again as a building display window during the daylight hours.

21 Claims, 2 Drawing Sheets

DISPLAY WINDOW APERTURE ADVERTISING MEDIUM

TECHNICAL FIELD

This invention relates to projected image display systems applicable for example for outdoor advertising. In particular, the invention provides a new advertising medium which provides a substitute for billboard and signboard advertising displays. More generally, the invention provides a novel indoor projection system in which a building display window defines the projection system display aperture for viewing from outside the building.

BACKGROUND ART

A variety of billboard and signboard systems are available for daytime and nighttime outdoor advertising. The McGee U.S. Pat. No. 3,198,066 and the Joss U.S. Pat. No. 2,491,184 describe outdoor advertising billboards convertible to projection screens for nighttime advertising messages. These patent references describe the use of front screen projection on the billboard for moving displays or for changing the displays periodically. The billboards are designed for traditional daytime billboard displays and nighttime use with a screen. A timing mechanism is provided for this purpose. The Cordill et al. U.S. Pat. No. 1,740,499, the Gould U.S. Pat. No. 1,644,580, and the Pierson U.S. Pat. No. 3,069,970 describe billboard and signboard arrangements with rear screen projection for providing animation and for changing the billboard displays.

Each of the foregoing patent references and existing billboard and signboard systems, however, contemplate traditional outdoor advertising billboards, signboards, and related equipment. A disadvantage of such advertising systems is that billboard and signboard advertising has been outlawed in many states along with off-premise advertising signs and billboards generally. No successful advertising medium has been devised as a substitute for such traditional billboard and signboard location advertising.

OBJECTS OF THE INVENTION

It is, therefore, an object of the present invention to provide a new advertising medium for outdoor advertising on a signboard or billboard scale.

Another object of the invention is to provide an image display system for effective outdoor advertising or other image display in which all image and sign display equipment are located inside of a building.

A further object of the invention is to provide a projected image display system applicable for outdoor advertising and other outdoor image display purposes in which the projected image or advertising message may be readily sequentially or periodically changed without the difficulties and expense associated with altering and changing signboard and billboard signs.

DISCLOSURE OF THE INVENTION

In order to accomplish these results the present invention provides a new projection system for projecting and displaying images on a billboard or signboard scale for viewing in which a building display window defines the display aperture or viewing aperture of the projection system for viewing projected images from outside the building. A feature and advantage of this arrangement is that all elements of the new advertising medium and image display system may be positioned on the protected side or inside of the projection system display aperture which forms part of the protective enclosure of the building.

According to the invention, a deployable and retractable rear projection screen, having a size area for substantially covering the display window aperture, is positioned for deployment in the display aperture adjacent to the display window. The rear projection screen is constructed and arranged for deployment in the display aperture adjacent to the display window and for retraction from the display aperture away from the display window so that the display window is unobstructed when the screen is retracted. A screen motor is operatively coupled to the screen for deployment and retraction of the screen.

Associated with, and operatively coupled to, the screen motor is a first timer such as a clock synchronized timer which is adjusted for generating a first timing signal to actuate the screen motor and deploy the screen at a selected first time of day after daylight hours, for example, at sunset or in the evening. The first timer is also adjusted for generating a second timing signal to actuate the screen motor for retracting the screen at a selected second time of day, for example, prior to daylight hours of the next day. By this arrangement the display window functions as the display aperture or viewing aperture of the projection system for viewing images from outside the building during selected evening or nighttime hours. On the other hand, during daylight hours the display window functions as a building display window without substantial obstruction or obscuring by the retracted screen. Upon deployment of the screen, the first timing signal also turns on an image projector.

The image projector is preferably a slide transparency projector operatively positioned inside the building for projecting still images along an optical path onto the rear projection screen when the screen is deployed in the display aperture. The slide transparency projector, or other image projector, is constructed and arranged for sequentially projecting a plurality of still images.

According to the invention a second timer, such as a solid state delay-on-break timer, is operatively coupled to the slide projector and is adjustable for generating sequential timing signals for advancing the slide projector for projection of sequential still images during selected time intervals. The time intervals are selected to be of sufficient duration to preclude objectionable or distracting motion effects to viewers outside the building. Many states prohibit elements of motion on signs along a roadway and time intervals of adequate duration must be selected to comply with such state laws. The second timer is actuated into operation by the first timer and first timing signal when the screen is deployed and the slide projector is turned on.

Upon completion of a sequence of advertising messages or other still images during the desired period of evening or nighttime hours, the second timing signal of the first timer turns off the slide projector and second timer and initiates the screen motor for retracting the screen. The slide projector fan remains on for a cooling period to extend bulb life.

In the preferred embodiment the projection screen is stored in the configuration of a roll, for example, in a canister at an edge of the display window. The screen motor is operatively coupled for unrolling the screen and drawing the screen across the window for deployment of the screen and for withdrawing and rolling up the screen for retracting the screen. The rear projection screen may be stored on a vertically oriented canister roll at the side of the display window. First and second belts positioned respectively at the upper and lower boundaries of the display window couple the screen motor and screen for deployment by unrolling and drawing the screen across the window and retraction by withdrawing and rolling up the screen. The belts do not obstruct the display window when the screen is rolled up and retracted. The belts may be in the form of endless loops.

The preferred embodiment also contemplates an optical element defining the optical path of the projection system so that the focal plane of projected images falls substantially of the display aperture and onto the deployed screen. The optical arrangement may include a plane mirror spaced from the display window inside the building on an adjustable mounting bracket for angular adjustment of the mirror, for example, in two dimensions or two planes. The slide projector or other image projector is directed at the mirror and the adjustable mirror directs the projected image onto the deployed screen at the display window aperture. By this arrangement, an optical path of sufficient length is afforded in the small space adjacent to the display window for establishing the focal plane at the display window aperture. Alternatively, or in addition, a wide angle lens may be incorporated in the slide projector.

A feature and advantage of the display window image projection system, according to the invention, is that it provides a new advertising medium which may be on a billboard and signboard scale for outdoor advertising through an indoor system but without the disadvantages of maintenance and expense associated with outdoor billboards and signboards. The invention makes use of valuable but underutilized space for delivering advertising messages or other information by using building display windows during night hours which are visible both to pedestrians and motorists. The invention also has application in the consumer field for use by home owners for delivering holiday messages and decorations using home windows as the apertures of the image projection system.

Other objects features and advantages of the present invention are apparent in the following specification and accompanying drawings.

DESCRIPTION OF PREFERRED EXAMPLE EMBODIMENTS AND BEST MODE OF THE INVENTION

Figure 1:
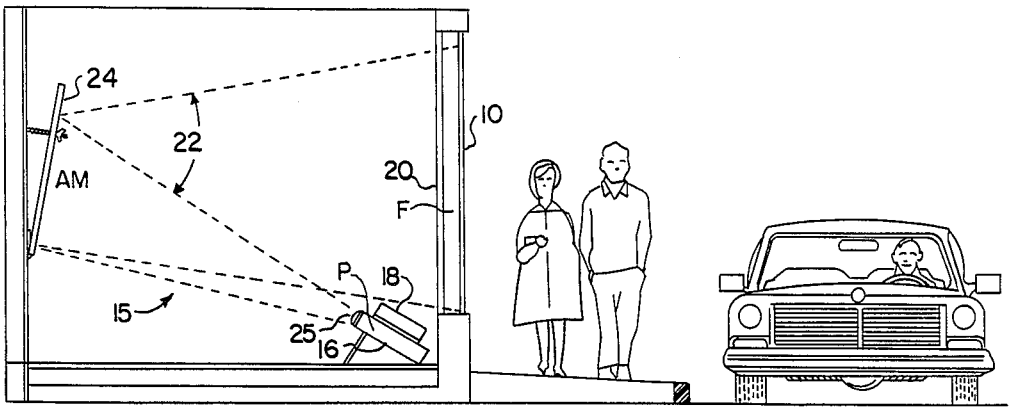
FIG. 1 is a diagrammatic side view of the display window image projection system showing a fragmentary portion of a building and the display window aperture or viewing aperture visible to pedestrians and motorists.
Figure 5:
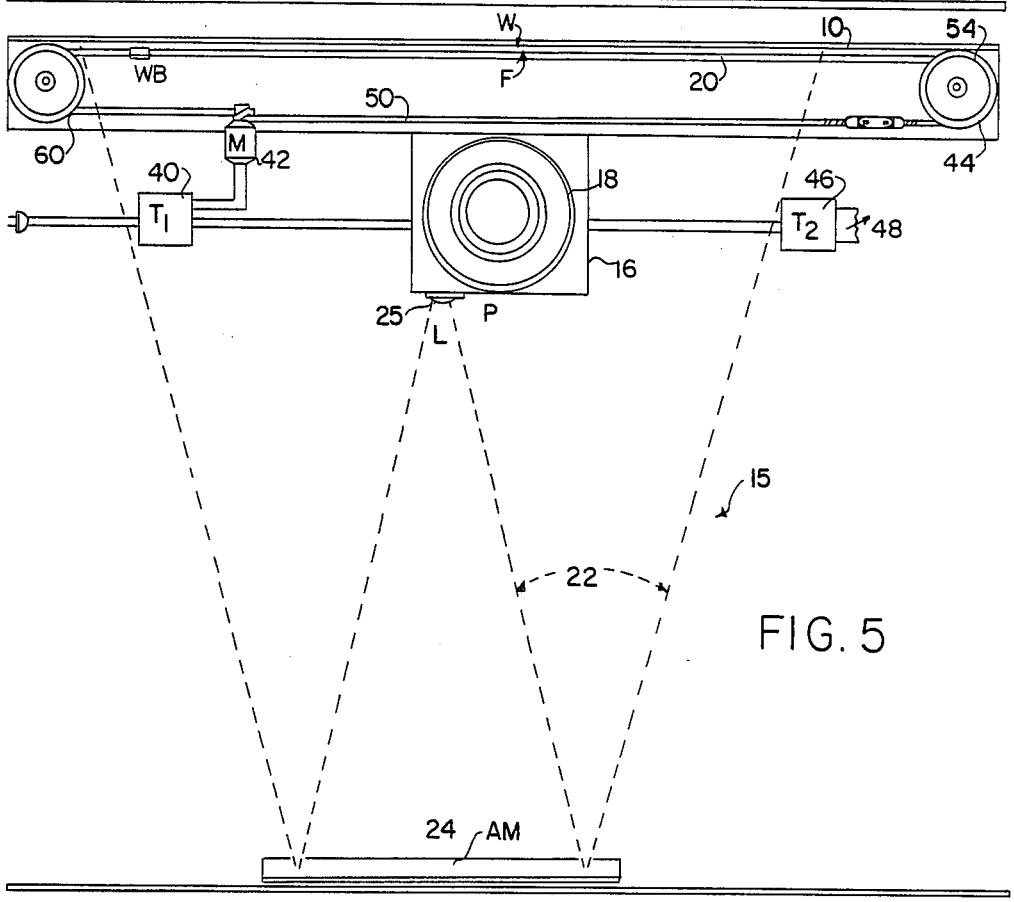
FIG. 5 is a diagrammatic view from above of the entire display window image projection system.

Referring first to the general system diagrams of FIGS. 1 and 5, the present invention incorporates the display window 10 of a building 12 as the integral optical aperture, display aperture, viewing aperture or viewing field of an image projection system 15. Slide projector 16 with slide cartridge 18 projects sequential images during specified time intervals onto a rear projection screen 20 in the viewing aperture of the image projection system adjacent to display window 10.

The slide projector 16 is directed away from the screen 20 at the viewing aperture and toward the back mirror 24 oriented to project the optical image information onto screen 20. Because of the folded optical path 22, the focal length of the projection system may be accommodated in the small space adjacent to display window or picture window 10. Alternatively, or in addition, the projector lens system 25 may comprise a wide angle lens so that the focal plane of the projected images falls at the plane of the screen 20 adjacent to display window aperture 10.

Figure 2:
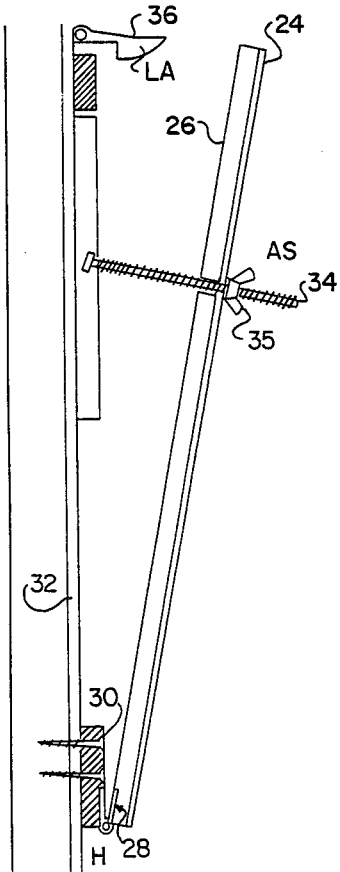
FIG. 2 is a detailed fragmentary side view of the adjustable back mirror in the optical path of the display window image projection system with the mirror in operating position.
Figure 3:
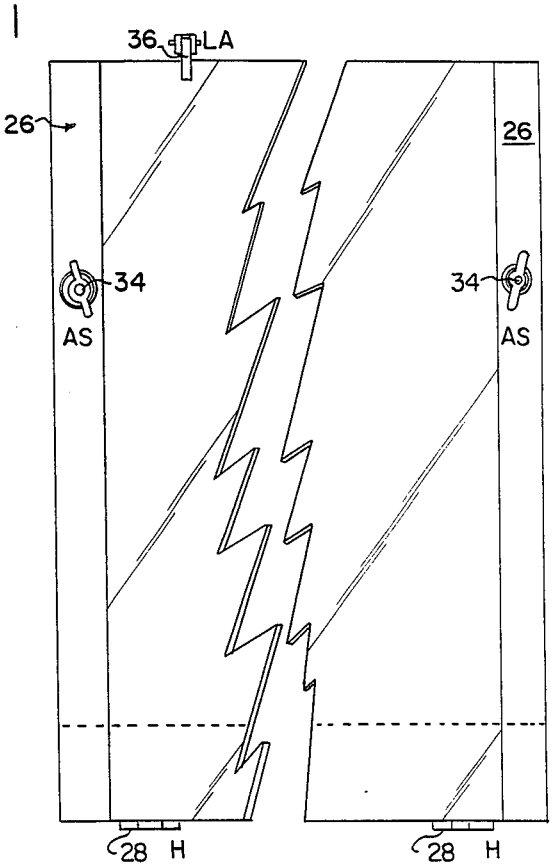
FIG. 3 is a fragmentary plan view of the back mirror showing the mirror stored in vertical position.

A detail of the adjustable mounting or mounting bracket arrangement for the back mirror 24 with the mirror in operating position is illustrated in FIG. 2. The plane mirror 24 is mounted on the backing or support 26 which is in turn hinge-mounted by hinges mounted 28 along the bottom of the backing support 26 to the mounting block 30 on interior wall 32 spaced from display window 10 on the inside of the building 12. Threaded adjustment bolts 34 permit adjustment of the angular orientation of mirror 24 in a vertical plane by pivotal motion on the horizontally oriented hinges 28. Butterfly nuts 35 are provided for convenient adjustment of the angular orientation of mirror 24 in a vertical plane by pivotal motion on the horizontally oriented hinges 28. Butterfly nuts 35 are provided for convenient adjustment of the angles so that the projected image falls squarely on the screen 20. By way of example, the mirror 24 is shown at an angle from the wall in operating position in FIG. 2 while in FIG. 3 the mirror 24 is shown in the storing vertical position held in place by latch 36.

Figure 4:
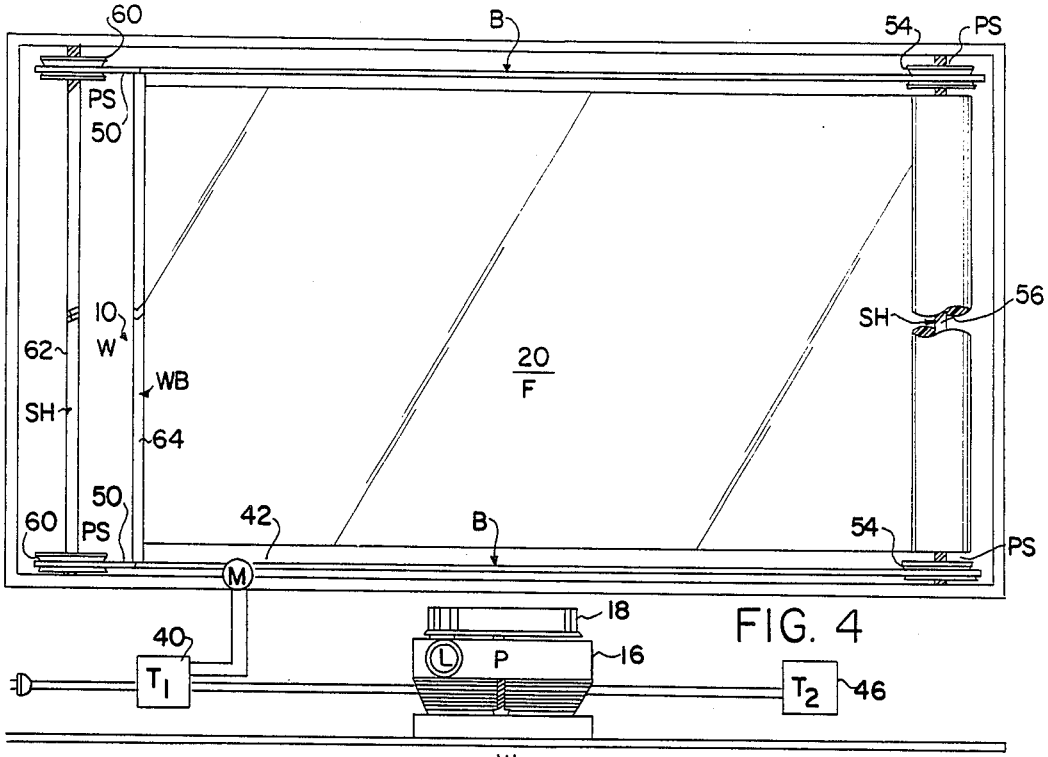
FIG. 4 is a diagrammatic rear view of the display window image projection system showing the rear projection screen, display window aperture and slide projector from inside the buiding.

Further details of the display window projection system and system operation are described with reference to FIGS. 4 and 5. The slide projector 16 is powered by conventional 120 volt 60 cycle AC current delivered through a clock synchronized timer 40. At a first selected time, for example at sunset or early evening, the timer 40 delivers power to slide projector 16, turning on the projector while at the same time activating the reversible electric motor or screen motor 42. The electric motor 42 draws the rear projection screen 20, which may be, for example, a translucent film such as drafting Mylar (TM) across the display window 10 from the roll 44 in which it is stored. After the screen 20 is deployed, the screen motor 42 is de-energized and turned off by the timer 40 at the separate output terminals to which it is coupled.

With the viewing screen 20 deployed across the display window aperture 10 and slide projector 16 turned on, a second timer 46 such as a solid state delay-on-break timer, periodically advances the cartridge 18 for sequentially changing the slide transparencies. The frequency of change of the projected images and the duration of the interval or period during which each image appears on the screen 20 at the display window aperture 10 is adjustable by means of a potentiometer element 48 in the circuit of timer 46. The frequency of change is selected so that the period or time duration of the interval during which each still image appears on the screen is of sufficient duration to avoid or preclude any objectionable or distracting motion effects on viewers outside the building. This is particlarly important where the display window aperture is visible to, and viewed by, motorists. At the very least, the time period or interval of display is of sufficient duration to avoid any flickering effect. For example, the time period of display for each projection image is not less than 10 to 15 seconds for a frequency of 4 to 5 per minute and preferably the period is at least several minutes.

In the foregoing example of a slide projector is used and the advertising message or other communication or visual display is enlarged through projection to fill the display window aperture. Alternatively, an opaque projector or overhead projector may be used for projecting other types of images through the display window image projection system. A feature and advantage of this image projection system is that the effect of an illuminated billboard after dark may be achieved in the aperture of a display window or picture window of a building. More importantly, the system of the present invention provides the capability of periodically changing the signboard or billboard scale display. The disadvantages inherent in traditional billboards, including weather deterioration and the expense of reposting or papering, are avoided. The present invention also contemplates additional variations. For example, the illuminating lamp and intensity of illumination of the image display may be varied according to conditions and the subject matter of the display. The system may also be provided with a manual override for control of the advertising message or communication under display.

At the end of a viewing period, typically during evening or nighttime hours, the clock syncronized timer 40 turns off the projector lamp of the slide projector 16 allowing the cooling blower to continue for the prescribed bulb cool-down period. After the cool-down period, the blower of slide projector 16 is also turned off. At the same time the, first timer 40 activates the reversible electric motor 42 for a period of time sufficient to withdraw, retract and rewind the screen 20 into the storage roll 44. The display window 20 is therefore ready to function as a display window during the next period of daylight hours. The slide tray or cartridge 18, or other set or cartridge of images to be projected, may be changed easily for conveying new advertising information or other communications.

For operation of the screen 20 and screen motor 42, the screen is coupled to the screen motor 42 by a pair of belts 50 in the configuration of endless loops. The endless loop belts 50 are supported at the screen roll end by a pair of pulleys 54 on a shaft 56. The screen 20 may be rolled directly on the shaft 56 during storage. The shaft may also be housed within a canister for protecting the rolled screen during storage.

The endless loop belts 50 are supported at the other ends by the pair of pulleys 60 on rotating shaft 62. The shafts 56 and 62 are spaced apart on either side of the display window 10. The screen 20 is secured to the pair of belt loops 50 by a batten 64 extending across the leading edge or end of screen 20. The ends of the batteries secured to the belt loops 50. The trailing edge or end of the screen 20 is secured to the shaft 56. Because the screen drive motor 42 drives the belt loops 50 directly, the pulleys 54 and 60 and shafts 56 and 62 are driven in syncronism. During deployment, the screen 20 is drawn by the belt loops 50 and batten 64 across, and adjacent to, the display window on the inside. During retraction, the shaft 56 rewinds the screen withdrawing the batten 64 back across.

The invention contemplates a number of other variations and combinations including a rear projection screen of the "Venetian blind" type construction with a plurality of separately pivotal parallel mounted slats which may be rotated or pivoted by an electric drive motor to orient the slats in a common plane or co-planar configuration for deployment as a screen. Subsequently, the slats may be rotated to a mutually parallel configuration in which each slat is perpendicular to the plane of the display window aperture to minimize obstructing or obscuring the display window. According to another variation and embodiment, a vertical pull-down screen may be used with the roller oriented horizontally across the top or above the display window.

In addition to the back reflecting plane mirror, other optical elements and arrangements may also be used for folding or controlling the optical path of the projected image so that the focal plane of the projection system lies substantially at the display window aperture and screen deployed across the display window.

While the invention has been described with reference to particular example embodiments, it is intended to cover all modifications and equivalents within the scope of the following claims.

I claim:

1. A new billboard scale outdoor advertising medium comprising:

a display window of a building, said display window defining the display aperture of a projection system for viewing projected images from outside the building;

a deployable and retractable rear projection screen having a size area sufficient for substatially covering the display window display aperture, said screen being positioned for deployment in the display aperture adjacent to the display window of a building inside the and for retraction from the display aperture away from the display window so that the display window is unobstructed when the screen is retracted;

screen motor means positioned inside the building and operatively coupled to the deployable and retractable screen for deployment of the screen in the display aperture adjacent to the display window and for retraction from the display aperture;

first timer means operatively coupled to the screen motor means, said first timer means being adjusted and arranged for generating a first timing signal to actuate the screen motor means for deployment of the screen at a selected first time of the delay and for generating a second timing signal to actuate the screen motor means for retraction of the screen at a selection second time of the day, whereby the display window functions as the display aperture of a projection system for viewing images from outside the building during a first time period of the day and whereby the display window functions as a building display window during a second time period of the day;

image projector means operatively positioned inside the building for projecting still images along an optical path onto the rear projection screen when the screen is deployed in the display aperture, said image projector means being constructed and arranged for sequentially projecting a plurality of still images;

optical means defining the optical path so that the focal plane of projected images falls substantially at the display aperture on the deployed screen;

second timer means operatively coupled to the image projector means, said second timer means being adjustable for generating sequential timing signals for advancing the image projector means for projection of sequential still images for time intervals of sufficient duration selected to preclude objectionable or distracting motion effects to viewers outside the building;

thereby providing at the building display window the display aperture of a billboard scale outdoor advertising medium with all equipment housed inside the building and with changeable advertising messages at the display aperture during the first time period of the day.

2. The projection system of claim 1, wherein the rear projection screen is stored in the configuration of a roll at an edge of the display window and, wherein said screen motor means is reversible and is operatively coupled for unrolling the screen across the window for deploying the screen and for rolling up and retracting the screen.

3. The projection system of claim 2, wherein the rear projection screen is stored in a roll at the edge of the display window and further comprising belt means operatively coupling the screen motor means and rear projection screen for unrolling and drawing the screen across the display window for deploying the screen and for rolling up and withdrawing the screen from the window for retracting the screen.

4. The projection system of claim 3, wherein the belt means comprises first and second belts positioned respectively at opposite boundaries of the display window so that the belts do not obstruct the display window when the screen is rolled up and retracted.

5. The projection system of claim 4, wherein the first and second belts comprise endless loops driven by the screen motor means, said screen comprising a leading end for deploying and retracting the screen on the roll and wherein the leading end of the screen is coupled to said first and second belts for deploying and retracting the screen.

6. The projection system of claim 1, wherein the image projector means comprises a slide transparency projector.

7. The projection system of claim 5 wherein the endless loop first and second belts are mounted on pulleys, said pulleys comprising a pair of pulleys mounted on a shaft on each side of the screen, said rear projection screen roll being formed on one shaft, said screen motor means being operatively coupled for rotation of said pulleys and shafts and translation of the leading edge of the screen in synchronism.

8. The projection system of claim 1, wherein the optical means comprises a mirror spaced from the display window inside the building, wherein the image projector means is directed at the mirror, and wherein the mirror angle is adjustable for directing a projected image onto the deployed screen at the display window display aperture.

9. The projection system of claim 8, wherein the mirror comprises a plane mirror hinge mounted at the bottom of the plane mirror for adjusting the vertical angle of the mirror and the optical path.

10. The projection system of claim 5, wherein the first timer means is adjusted and arranged for generating a first timing signal to actuate the screen motor means for deployment of the screen after daylight hours.

11. The projector system of claim 10, wherein the first timer means is adjusted and arranged for generating a second timing signal to actuate the screen motor means for retracting the screen before daylight hours.

12. The projection system of claim 11, wherein the second timer means is adjusted for generating sequential timing signals for projection of sequential still images during time intervals of at least fifteen seconds duration.

13. The projection system of claim 8, further comprising bracket mounting means for supporting said mirror, said bracket mounting means being adjustable in two dimensions for orienting the mirror in two planes.

14. The projection system of claim 1, wherein the rear projection screen comprises a sheet of translucent polymer film.

15. A new billboard scale outdoor advertising medium comprising:

a building display window, said display window defining the image display aperture of a projection system for viewing of projected images from outside the building;

a deployable and retractable rear projection screen having size area sufficient for substantially covering the display window display aperture, said screen being positioned for deployment in the display aperture adjacent to the display window inside the building and for retraction from the display aperture away from the display window so that the display window is unobstructed when the screen is retracted, said screen being stored in a vertically oriented canister at the side of the display window;

screen motor means positioned inside the building and belt means operatively coupling the screen motor means to the deployable and retractable screen for deployment of the screen by unrolling and drawing the screen from the canister across the display aperture adjacent to the display window and for retraction of the screen by withdrawing the screen from the display aperture and rolling up the screen in the canister;

first timer means operatively coupled to the screen motor means, said first timer means being adjusted and arranged for generating a first timing signal to actuate the screen motor means for deployment of the screen after daylight hours of the day and for generating a second timing signal to actuate the screen motor means for retraction of the screen prior to daylight hours of the day, whereby the display window functions as the display aperture of a projection system during selected hours of substantial darkness for viewing images from outside the building and, whereby the display window functions as a building display window during daylight hours of the day;

slide transparency projector means operatively positioned inside the building for projecting still images along an optical path onto the rear projection screen when the screen is deployed in the display aperture, said slide transparency projector means comprising a slide cartridge mounting constructed and arranged for sequentially projecting a plurality of still images;

a mirror spaced from the display window inside the building, said slide transparency projector means being directed at the mirror, and wherein the angular orientation of the mirror is adjustable for directing a projected image on the deployed screen at the display window display aperture, said mirror being adjusted and arranged to define the optical path so that the focal plane of projected images falls substantially at the display aperture on the deployed screen;

second timer means operatively coupled to said slide transparency projector means, said second timer means being adjustable for generating sequential timing signals for advancing the slide transparency projector means for projection of sequential images during time intervals of sufficient duration selected to preclude objectionable or distracting motion effects to viewers outside the building;

thereby providing at the building display window the display aperture of a billboard scale outdoor advertising medium with all equipment housed inside the building and with changeable advertising messages at the display aperture during the first time period of the day.

16. The projection system of claim 15, wherein the mirror comprises a plane mirror and further comprising adjustable bracket mounting means for mounting said mirror, said mounting bracket means being adjustable in two independent dimensions for adjusting the angular orientation of the mirror in two planes.

17. The projection system of claim 15, wherein the belt means comprises first and second belts positioned respectively at the upper and lower boundaries of the display window so that the belts do not obstruct or obscure the display window when the screen is rolled up and retracted.

18. The projection system of claim 17, wherein the first and second belts are endless loops driven by the screen motor means, said screen comprising a leading end for deploying and retracting the screen on the roll and wherein the leading end of the screen is coupled to said first and second belts for deploying and retracting the screen.

19. The projection system of claim 18 wherein the endless loop first and second belts are mounted on pulleys, said pulleys comprising a pair of pulleys mounted on a shaft on each side of the screen, said rear projection screen roll being formed on one shaft, said screen motor means being operatively coupled for rotation of said pulleys and shafts and translation of the leading edge of the screen in synchronism.

20. A method of displaying outdoor advertising messages and other communications on a billboard scale comprising:

mounting a deployable and retractible rear projection screen adjacent to a display window of a building;

assembling elements of an image projection system including an image projector and optical path defining optical elements inside the building with reference to the display window of the building so that the display window constitutes and defines the display aperture or viewing aperture substantially at the focal plane of the image projection system;

deploying the rear projection screen across the display window aperture of the image projection system at a first selected time after the daylight hours of the day and actuating the image projector;

periodically advancing the image projector so that different still images are sequentially projected on the rear projection screen during time intervals of sufficient duration to preclude objectionable or distracting motion effects on viewers outside the building;

turning off the image projector at a second selected time prior to daylight hours of the day and retracting the screen from the display window aperture so that the display window functions as the display aperture of the projection system during selected hours of substantial darkness for viewing images from outside the building and so that the display window functions as a building display window during daylight hours of the day.

21. A method of displaying outdoor advertising messages and other communications on a billboard scale comprising:

providing a rear projection screen adjacent to a display window of a building on the inside of the building;

assembling elements of an image projection system including an image projector and optical path defining optical elements inside the building with reference to the display window of the building so that the display window constitutes and defines the display aperture or viewing aperture substantially at the focal plane of the image projection system;

deploying the rear projection screen across the display window aperture of the image projection system at a first selected time after the daylight hours of the day and actuating the image projector;

periodically advancing the image projector so that different still images are sequentially projected on the rear projection screen during time intervals of sufficient duration to preclude objectionable or distracting motion effects on viewers outside the building;

turning off the image projector at a second selected time prior to daylight hours of the day and removing the screen from the display window aperture so that the display window functions as the display aperture of the projection system during selected hours of substantial darkness for viewing images from outside the building and so that the display window may function as a building display window during daylight hours of the day.

* * * * *